US006833520B1

(12) United States Patent
Wong et al.

(10) Patent No.: US 6,833,520 B1
(45) Date of Patent: Dec. 21, 2004

(54) SUSPENDED THIN-FILM RESISTOR

(75) Inventors: Marvin Glenn Wong, Woodland Park, CO (US); Ling Liu, Colorado Springs, CO (US)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 10/462,395

(22) Filed: Jun. 16, 2003

(51) Int. Cl.[7] ..... H01H 29/00
(52) U.S. Cl. ..... 200/182; 200/187; 338/309
(58) Field of Search ..... 200/182, 193, 200/187–190; 338/307, 309, 312, 314, 329; 174/138, 260; 257/E23.013, E21.587; 438/384, 619

(56) References Cited

U.S. PATENT DOCUMENTS

| | | | |
|---|---|---|---|
| 2,312,672 | A | 3/1943 | Pollard, Jr. |
| 2,564,081 | A | 8/1951 | Schilling |
| 3,430,020 | A | 2/1969 | Von Tomkewitsch et al. |
| 3,529,268 | A | 9/1970 | Rauterberg |
| 3,600,537 | A | 8/1971 | Twyford |
| 3,639,165 | A | 2/1972 | Rairden, III |
| 3,657,647 | A | 4/1972 | Beusman et al. |
| 4,103,135 | A | 7/1978 | Gomez et al. |

(List continued on next page.)

FOREIGN PATENT DOCUMENTS

| | | |
|---|---|---|
| EP | 0593836 A1 | 4/1994 |
| FR | 2418539 | 9/1979 |
| FR | 2458138 | 12/1980 |
| FR | 2667396 | 4/1992 |
| JP | 38-18575 | 10/1961 |
| JP | 47-21645 | 10/1972 |
| JP | 62-276836 | 12/1987 |
| JP | 63-294317 | 12/1988 |
| JP | 8-125487 | 5/1996 |
| JP | 9-161640 | 6/1997 |
| WO | WO99-46624 | 9/1999 |

OTHER PUBLICATIONS

NB8408827, "Integral Power Resistors for Aluminum Substrate", IBM Technical Disclosure Bulletin, Jun. 1, 1984, vol. 27, 18, p. 827.

Marvin Glenn Wong, "Thin–Film Resistor Device", U.S. Appln. No. 10/413,798 (pending), filed Apr. 14, 2003, 17 pages of specification and 5 sheets of drawings (Figs. 1–11).

TDB–ACC–No: N88406827, "Integral Power Resistors for Aluminum Substrate", IBM Technical Disclosure Bulletin, Jun. 1984, US, vol. 27, Issue No. 18, p. 827.

Bhedwar, Homi C., et al., "Ceramic Multilayer Package Fabrication", Electronic Materials Handbook, Nov. 1989, pp 460–469, vol. 1 Packaging, Section 4: Packages.

Kim, Joonwon, et al., "A Micromechanical Switch With Electrostatically Driven Liquid–Metal Droplet", Sensors And Actuators, A; Physical v 9798, Apr. 1, 2002, 4 pages.

Marvin Glenn Wong, U.S. Appln. No. 10/137,691 (pending), "A Piezoelectrically Actuated Liquid Metal Switch", May 2, 2002.

J. Simon, et al., "A Liquid–Filled Microrelay with a Moving Mercury Microdrop", Journal of Microelectromechanical Systems, vol. 6, No. 3, Sep. 1997, pp. 208–216.

*Primary Examiner*—Michael Friedhofer
*Assistant Examiner*—Lisa Klaus

(57) ABSTRACT

A suspended thin-film resistor and methods for producing the same are disclosed. In one embodiment, a device is produced by depositing a first and second contact on a substrate, depositing a sacrificial material on the substrate at a location between the first and second contacts, depositing a thin-film resistor over the first and second contacts and the sacrificial material, and thermally decomposing the sacrificial material.

13 Claims, 4 Drawing Sheets

U.S. PATENT DOCUMENTS 4,200,779 A 4/1980 Zakurdaev et al.
4,238,748 A 12/1980 Goullin et al.
4,245,886 A 1/1981 Kolodzey et al.
4,336,570 A 6/1982 Brower
4,419,650 A 12/1983 John
4,434,337 A 2/1984 Becker
4,475,033 A 10/1984 Willemsen et al.
4,505,539 A 3/1985 Auracher et al.
4,582,391 A 4/1986 Legrand
4,628,161 A 12/1986 Thackrey
4,652,710 A 3/1987 Karnowsky et al.
4,657,339 A 4/1987 Fick
4,742,263 A 5/1988 Harnden, Jr. et al.
4,786,130 A 11/1988 Georgiou et al.
4,797,519 A 1/1989 Elenbaas
4,804,932 A 2/1989 Akanuma et al.
4,988,157 A 1/1991 Jackel et al.
5,278,012 A 1/1994 Yamanaka et al.
5,323,138 A * 6/1994 Oki et al. ..... 338/307
5,415,026 A 5/1995 Ford
5,502,781 A 3/1996 Li et al.
5,644,676 A 7/1997 Blomberg et al.
5,675,310 A 10/1997 Wojnarowski et al.
5,677,823 A 10/1997 Smith
5,751,074 A 5/1998 Prior et al.
5,751,552 A 5/1998 Scanlan et al.
5,828,799 A 10/1998 Donald
5,841,686 A 11/1998 Chu et al.
5,849,623 A 12/1998 Wojnarowski et al.
5,874,770 A 2/1999 Saia et al.
5,875,531 A 3/1999 Nellissen et al.
5,886,407 A 3/1999 Polese et al.
5,889,325 A 3/1999 Uchida et al.
5,912,606 A 6/1999 Nathanson et al.
5,915,050 A 6/1999 Russell et al.
5,972,737 A 10/1999 Polese et al.
5,994,750 A 11/1999 Yagi
6,021,048 A 2/2000 Smith
6,180,873 B1 1/2001 Bitko
6,201,682 B1 3/2001 Mooij et al.
6,207,234 B1 3/2001 Jiang
6,212,308 B1 4/2001 Donald
6,225,133 B1 5/2001 Yamamichi et al.
6,278,541 B1 8/2001 Baker
6,304,450 B1 10/2001 Dibene, II et al.
6,320,994 B1 11/2001 Donald et al.
6,323,447 B1 11/2001 Kondoh et al.
6,331,811 B2 * 12/2001 Shibuya et al. ..... 338/308
6,351,579 B1 2/2002 Early et al.
6,356,679 B1 3/2002 Kapany
6,373,356 B1 4/2002 Gutierrez et al.
6,381,022 B1 * 4/2002 Zavracky ..... 356/454
6,396,012 B1 5/2002 Bloomfield
6,396,371 B2 5/2002 Streeter et al.
6,408,112 B1 6/2002 Bartels
6,446,317 B1 9/2002 Figueroa et al.
6,453,086 B1 9/2002 Tarazona
6,470,106 B2 10/2002 McClelland et al.
6,487,333 B2 11/2002 Fouquet
6,489,842 B2 * 12/2002 Eng ..... 330/43
6,501,354 B1 12/2002 Gutierrez et al.
6,512,322 B1 1/2003 Fong et al.
6,515,404 B1 2/2003 Wong
6,516,504 B2 2/2003 Schaper
6,559,420 B1 5/2003 Zarev
6,633,213 B1 10/2003 Dove
2002/0037128 A1 3/2002 Burger et al.
2002/0146197 A1 10/2002 Yong
2002/0150323 A1 10/2002 Nishida et al.
2002/0168133 A1 11/2002 Saito
2003/0035611 A1 2/2003 Shi

* cited by examiner

SUSPENDED THIN-FILM RESISTOR

BACKGROUND OF THE INVENTION

Thin film resistors can be used to generate heat. When heated, some of these resistors reach high temperatures (e.g., 400–600° Celsius). In some environments, the resistors are temperature cycled repeatedly. During the ramp-up portions of their temperature cycles, the resistors often heat much more quickly than the substrates on which they are deposited, thereby subjecting the resistors to compressive stresses. In a similar fashion, the resistors are subjected to tensile stresses during the ramp-down portions of their temperature cycles (because the resistors often cool much more quickly than the substrates on which they are deposited). These repeated stresses fatigue the resistors, and sometimes cause the resistors to crack.

Additionally, because the thin-film resistor is contacting the substrate, the heating process is not efficient. The heat lost in the substrate may be an order of magnitude higher than the heat generated above the resistor.

SUMMARY OF THE INVENTION

A suspended thin-film resistor and methods for producing the same are disclosed. In one embodiment, a device Is produced by depositing a first and second contact on a substrate. A sacrificial material is deposited on the substrate at a location between the first and second contacts. A thin-film resistor is deposited over the first and second contacts and the sacrificial material. Finally, the sacrificial material is thermally decomposed.

BRIEF DESCRIPTION OF THE DRAWINGS

Illustrative embodiments of the invention are illustrated in the drawings in which.

DETAILED DESCRIPTION

Figure 1:
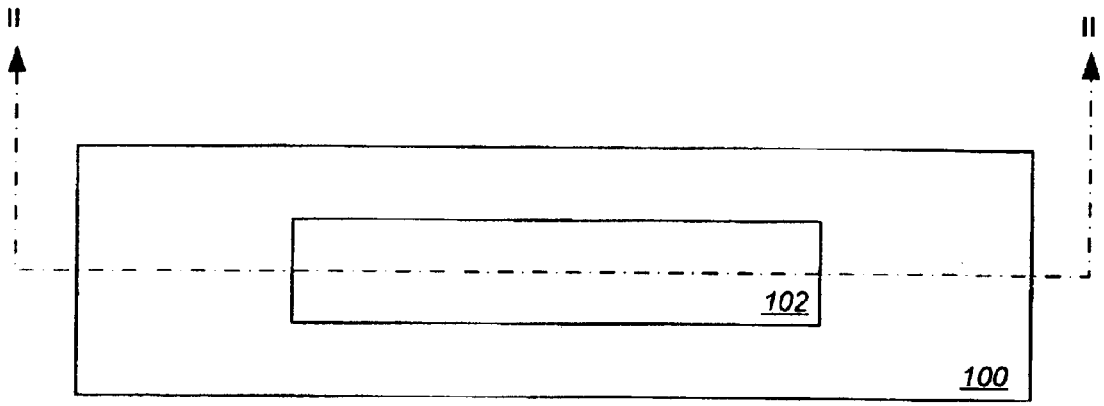
FIG. 1 illustrates an exemplary plan view of a suspended thin-film resistor.
Figure 2:
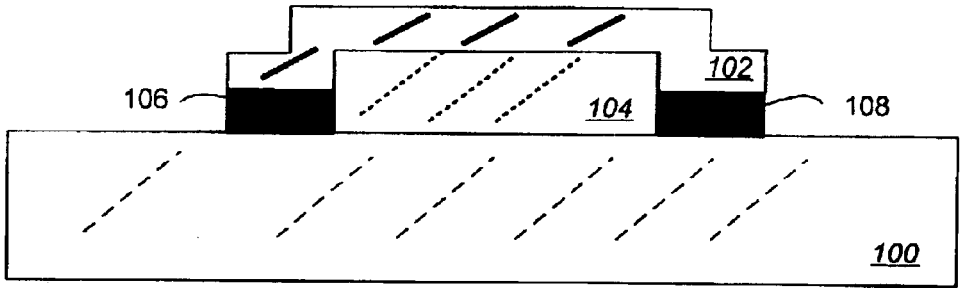
FIG. 2 illustrates an elevation view of the resistor shown in FIG. 1 before a sacrificial material has been removed.
Figure 3:
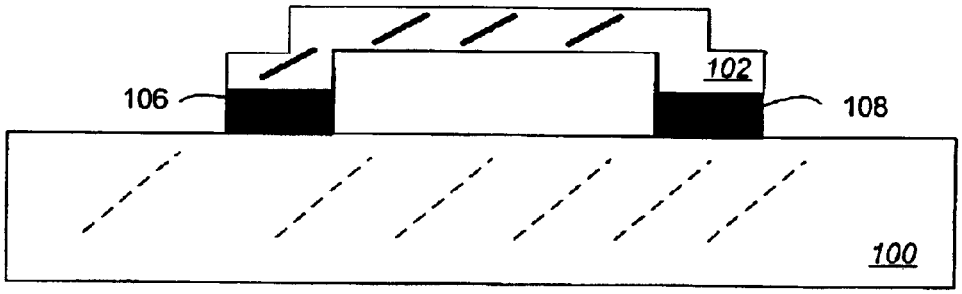
FIG. 3 illustrates the resistor shown in FIGS. 1 and 2 after the sacrificial material has been removed.
Figure 4:
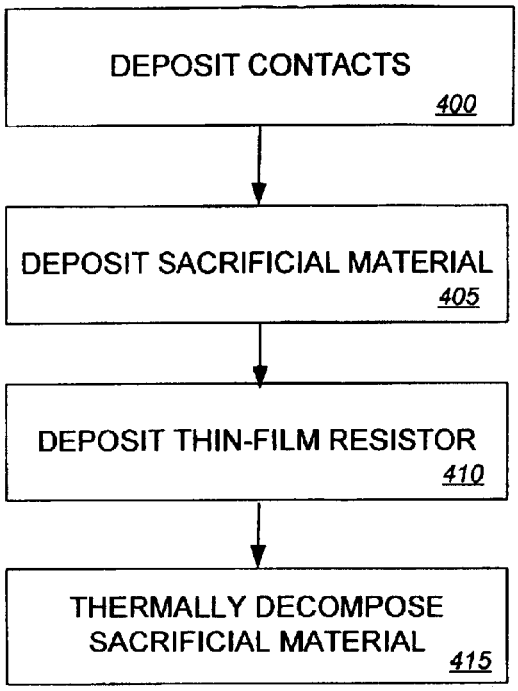
FIG. 4 illustrates an exemplary method that may be used to produce the thin-film resistor of FIGS. 1–3.

An exemplary embodiment of a suspended thin-film resistor is illustrated in FIGS. 1–3. As illustrated in FIG. 4, the thin-film resistor may be produced by first depositing 400 a first 106 and second contact 108 on a substrate 100. By way of example, the contacts 106, 108 may be deposited by sputtering, evaporation, or screen printing and firing. Other methods may also be used to deposit the contacts 106, 108 on the substrate.

Next, a sacrificial material 104 is deposited 405 on the substrate 100 at a location between the first and second contacts. In one embodiment, the sacrificial material 104 may be deposited by spin coating the sacrificial material on the substrate 100 and the first and second contacts 106, 108. A mask layer may then be deposited on the sacrificial material 104 and a photoresist material may be spin-coated and patterned on the mask layer at a location between first and second contacts 106, 108. A portion of the mask layer not layered by the photoresist material may then be etched away and the photoresist material may then be removed. Reactive ion etching may be used to remove the sacrificial material not layered by the mask layer. Finally, a portion of the mask layer may be etched away. It should be appreciated that in alternate embodiments, other methods may be used to deposit the sacrificial material 104 so that it is located between the first 106 and second 108 contacts.

After the sacrificial material 104 has been deposited 405, a thin-film resistor 102 is then deposited over the first 106 and second contacts 108 and the sacrificial material 104. The thin-film resistor may be deposited on the compliant material by spin-coating, patterning, or any other method. By way of example, the thin-film resistor 102 may be a metal resistor such as molybdenum or tungsten.

The sacrificial material 104 comprises a material that decomposes at a lower temperature than the material used for the thin-film resistor. After the thin-film resistor 102 has been deposited 410, the sacrificial material 104 is thermally decomposed 415. By way of example, the sacrificial material 104 may be polynorbornene and may be decomposed at 425° Celsius at oxygen concentrations below 5 parts per million (ppm). Other suitable materials and temperatures may be used to thermally decompose sacrificial material 104. As illustrated in FIG. 3, the removal of the sacrificial material 104 causes a section of the thin-film resistor 102 located between the two contacts 106, 108 and above the sacrificial material 104 to be suspended above the substrate 100.

It should be appreciated that thermal decomposition may provide better geometric control and/or less chemical disturbance to substrate 100 and any circuitry residing on substrate 100 than alternative methods. The structure of the suspended resistor 102 may be more stable using thermal decomposition than wet chemical removal, which may cause the suspended resistor to collapse due to the surface tension of the chemicals pulling the suspended structure towards the substrate 100. Additionally, unlike high temperature oxidation processes or the use of harsh chemicals, thermal decomposition may cause less damage or none at all to the substrate or components residing on the substrate.

In some embodiments, the thin-film resistor 102 may be used to generate heat. Because the resistor 102 is suspended above the substrate 100, stresses to the resistor caused by heating and cooling cycles are minimized. Additionally, unlike resistors that are not suspended, heat loss to the substrate is minimal or non-existent.

Figure 5:
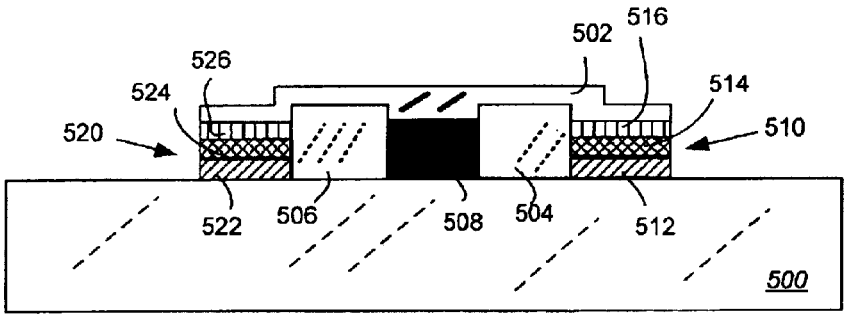
FIG. 5 illustrates an elevation view of a second exemplary embodiment of a suspended thin-film resistor before a sacrificial material has been removed.
Figure 6:
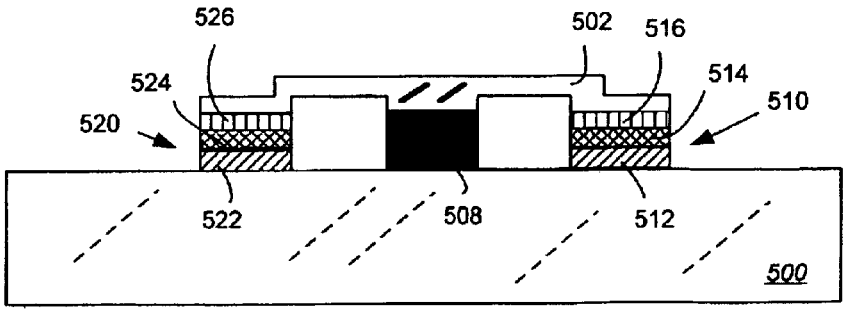
FIG. 6 illustrates the resistor of FIG. 5 after the sacrificial material has been removed.

A second exemplary embodiment of a suspended thin-film resistor is illustrated in FIGS. 5 and 6. First 510 and second 520 contacts are deposited on substrate 500. First contact 510 comprises three layers: first layer 512, second layer 514, and third layer 516. Second contact 520 similarly comprises first layer 522, second layer 524, and third layer 526. By way of example, first layers 512, 522 may chromium, second layers 514, 524 may be platinum, and third layers 516, 526 may be gold. In one embodiment, the contacts 510, 520 may have a lower resistance than the thin-film resistor 502. Because the contacts 510, 520 have a lower resistance, the temperature at the substrate 500 may be minimized when the resistor 502 is used to generate heat. This may reduce mechanical stresses caused by heating and cooling the resistor 502. It should be appreciated that in alternate embodiments, contacts 510, 520 may be comprised of different materials, may be single layer contacts, or may include more layers than that illustrated in FIGS. 5 and 6.

Support material 508 is deposited between contacts 510 and 520. Support material may be comprised of any material and may be used to support a section of thin-film resistor 502 after it has been suspended. In one embodiment, support material comprises the same material used for first and second contacts and has a lower resistance than resistor 502. It should be appreciated that alternate embodiments may not include support material 508.

Sacrificial material 504 is deposited between support material 508 and first contact 510. Similarly, sacrificial material 506 is deposited between support material 508 and second contact 520. Thin-film resistor 502 is deposited on contacts 510, 520 and support material 508. By way of example, sacrificial material comprises polynorbornene and thin-film resistor 502 comprises a metal resistor, such as molybdenum. Other suitable compositions may be used. Sacrificial material 504, 506 is thermally decomposed to produce the suspended resistor 502 illustrated in FIG. 6.

Figure 7:
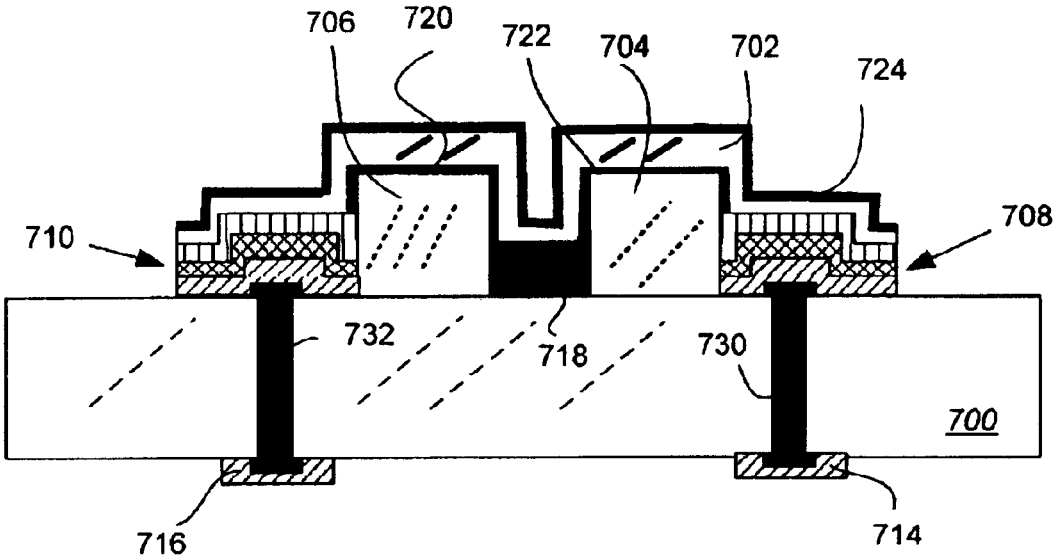
FIG. 7 illustrates an elevation view of a third exemplary embodiment of a suspended thin-film resistor before a sacrificial material has been removed.
Figure 8:
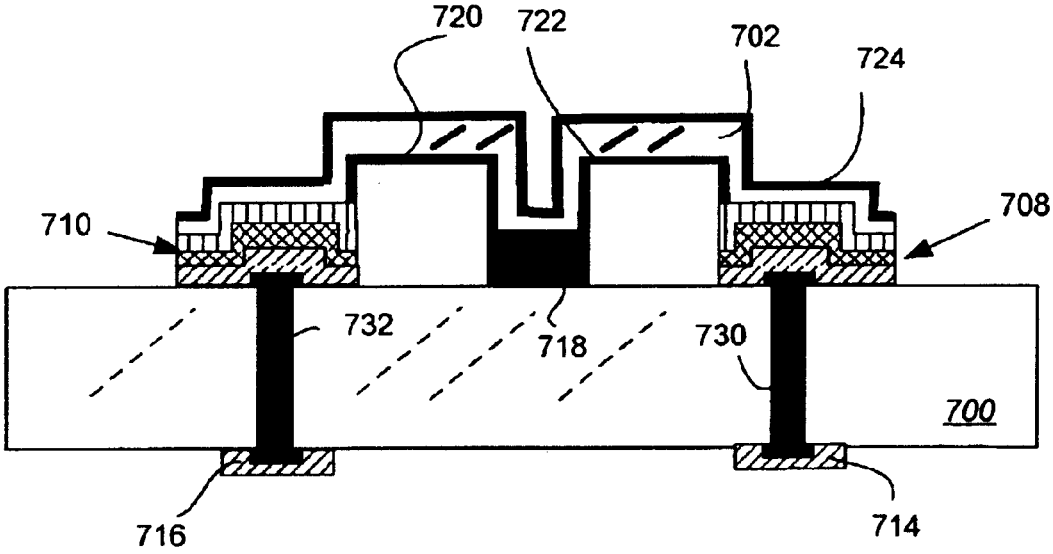
FIG. 8 illustrates the resistor of FIG. 7 after the sacrificial material has been removed.

FIGS. 7 and 8 illustrate a third exemplary embodiment of a suspended thin-film resistor. Substrate 700 comprises conductive vias 730, 732. Via 730 leads from a contact 708 deposited on a first surface of the substrate 700 to contact 714 deposited on an opposite surface of the substrate 700. Similarly, via 732 leads from contact 710 deposited on the first surface of the substrate to contact 716 deposited on the opposite surface. Contacts 708, 710, 714, 716 may be single-layer or multiple-layer contacts. Additionally, contacts 708, 710 may have a lower resistance than resistor 702.

Support material 718 is deposited between contacts 710 and 720. It may be used to support a section of thin-film resistor 702 after it has been suspended. Sacrificial material 704 is deposited between support material 718 and contact 708. Similarly, sacrificial material 706 is deposited between support material 718 and contact 710. It should be appreciated that alternate embodiments may not include support material 718.

A first support layer 720 is deposited on sacrificial material 706 so that it contacts a portion of contact 710 and support material 718. Similarly support layer 722 is deposited on sacrificial material 704 so that it contacts a portion of contact 708 and support material 718. By way of example, support layers 720, 722 may comprises silicon nitride and may be used to support a section of thin-film resistor 702 after it has been suspended. Alternate embodiments may not include support layers 720, 722.

Thin-film resistor 702 is deposited on contacts 708, 710 and support layers 720, 722 in a manner causing the thin-film resistor 702 to be corrugated. A second support layer 724 (e.g., silicon nitride) is deposited on thin-film resistor 702. It should be appreciated that in alternate embodiments, the thin-film resistor may not be corrugated and/or may not include second support layer 724. After sacrificial material 704, 706 has been removed (e.g., by thermal decomposition), thin-film resistor 702 is suspended above substrate 700 as illustrated in FIG. 8.

In one embodiment, the thin-film resistor 702 is used to generate heat. As the thin-film resistor 702 starts to heat up and expand, the corrugation of the resistor may allow it to contract, similar to an accordion. When the resistor is turned off and starts to cool, the corrugation of the resistor may allow it to expand. Thus, the stresses on the resistor caused by the cooling and heating cycles may be reduced.

Figure 9:
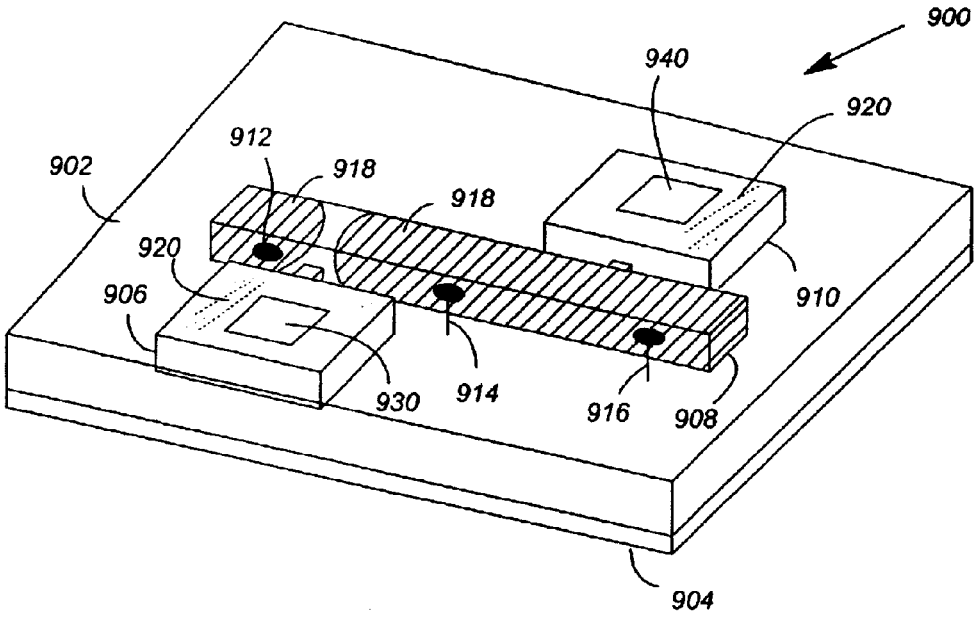
FIG. 9 illustrates a first exemplary embodiment of a switch comprising a suspended thin-film resistor heater.

In one embodiment, a thin-film resistor may be used in a micro-electrical mechanical system (MEMS) in a fluid-based switch (e.g., liquid metal micro switch (LIMMS)). FIG. 9 illustrates a first exemplary embodiment of a LIMMS switch 900. The switch 900 comprises a first substrate 902 and a second substrate 904 mated together. The substrates 902 and 904 define between them a number of cavities 906, 908, and 910. Exposed within one or more of the cavities are a plurality of electrodes 912, 914, 916. A switching fluid 918 (e.g., a conductive liquid metal such as mercury) held within one or more of the cavities serves to open and close at least a pair of the plurality of electrodes 912–916 in response to forces that are applied to the switching fluid 918. An actuating fluid 920 (e.g., an inert gas or liquid) held within one or more of the cavities serves to apply the forces to the switching fluid 918.

A suspended thin-film resistor 930 (such as a metal resistor) is deposited over a pair of contacts and located within actuating fluid cavity 906. Similarly, a suspended thin-film resistor 940 is deposited over a pair of contacts located within actuating fluid channel 910. Thin-film resistors 930, 940 may have been suspended by thermally decomposing sacrificial material. It should be appreciated that in alternate embodiments, thin-film resistors 930, 940 may be part of a configuration similar to that of any of the configurations described above.

In one embodiment of the switch 900, the forces applied to the switching fluid 918 result from pressure changes in the actuating fluid 920. The pressure changes in the actuating fluid 920 impart pressure changes to the switching fluid 918, and thereby cause the switching fluid 918 to change form, move, part, etc. In FIG. 9, the pressure of the actuating fluid 920 held in cavity 906 applies a force to part the switching fluid 918 as illustrated. In this state, the rightmost pair of electrodes 914, 916 of the switch 900 are coupled to one another. If the pressure of the actuating fluid 920 held In cavity 906 is relieved, and the pressure of the actuating fluid 920 held in cavity 910 is increased, the switching fluid 918 can be forced to part and merge so that electrodes 914 and 916 are decoupled and electrodes 912 and 914 are coupled.

By way of example, pressure changes in the actuating fluid 920 may be achieved by means of heating the actuating fluid 920 with thin-film resistors 930, 940. This process is described in more detail in U.S. Pat. No. 6,323,447 of Kondoh et al. entitled "Electrical Contact Breaker Switch, Integrated Electrical Contact Breaker Switch, and Electrical Contact Switching Method", which is hereby incorporated by reference for all that it discloses. Other alternative configurations for a fluid-based switch are disclosed in U.S. patent application Ser. No. 10/137,691 of Marvin Glenn Wong filed May 2, 2002 and entitled "A Piezoelectrically Actuated Liquid Metal Switch", which is also incorporated by reference for all that it discloses. Although the above referenced patent and patent application disclose the movement of a switching fluid by means of dual push/pull actuating fluid cavities, a single push/pull actuating fluid cavity might suffice if significant enough push/pull pressure changes could be imparted to a switching fluid from such a cavity.

Additional details concerning the construction and operation of a switch such as that which is illustrated in FIG. 9 may be found in the afore-mentioned patent of Kondoh et al., and patent application of Marvin Wong.

As described elsewhere in this application, by using suspended thin-film resistors 930 and 940, the stresses the resistors are subject to during the heating and cooling cycles may be reduced. Additionally, heat loss to substrate 904 may be minimal or non-existent. Thus, the fatigue life and efficiency of the thin-film resistors may be increased.

Figure 10:
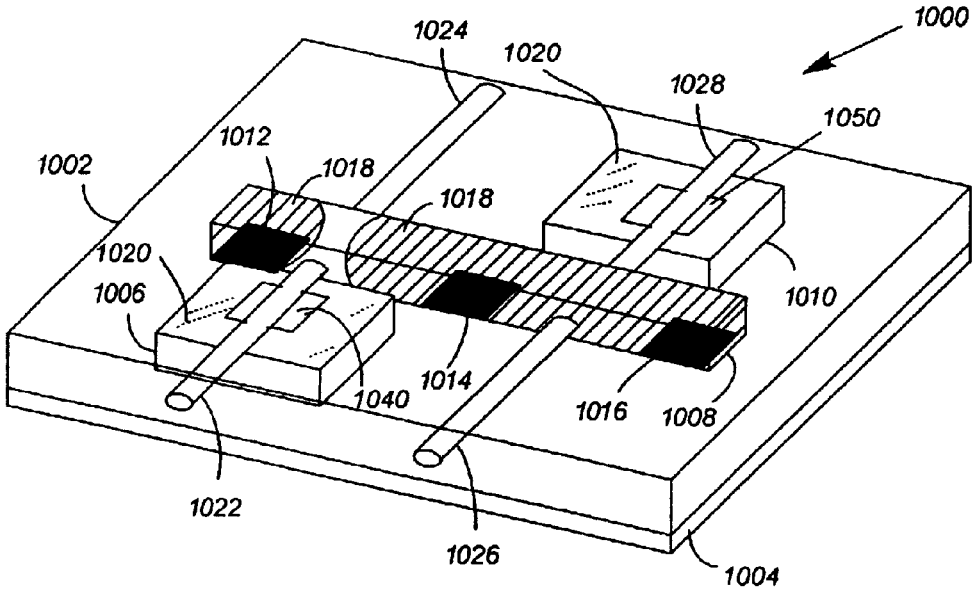
FIG. 10 illustrates a second exemplary embodiment of a switch comprising a suspended thin-film resistor heater.

FIG. 10 illustrates a second exemplary embodiment of a switch 1000. The switch 1000 comprises a substrate 1002 and a second substrate 1004 mated together. The substrates 1002 and 1004 define between them a number of cavities 1006, 1008, 1010. Exposed within one or more of the cavities are a plurality of wettable pads 1012–1016. A switching fluid 1018 (e.g., a liquid metal such as mercury) is wettable to the pads 1012–1016 and is held within one or more of the cavities. The switching fluid 1018 serves to open and block light paths 1022/1024, 1026/1028 through one or more of the cavities, in response to forces that are applied to the switching fluid 1018. By way of example, the light paths may be defined by waveguides 1022–1028 that are aligned with translucent windows in the cavity 1008 holding the switching fluid. Blocking of the light paths 1022/1024, 1026/1028 may be achieved by virtue of the switching fluid 1018 being opaque. An actuating fluid 1020 (e.g., an inert gas or liquid) held within one or more of the cavities serves to apply the forces to the switching fluid 1018.

A suspended thin-film resistor 1050 (such as a metal resistor) is deposited over a pair of contacts and located within actuating fluid cavity 1006. Similarly, a suspended thin-film resistor 1040 is deposited over a pair of contacts located within actuating fluid channel 1010. Thin-film resistors 1040, 1050 may have been suspended by thermally decomposing sacrificial material. It should be appreciated that thin-film resistors 1040, 1050 may be part of a configuration similar to that of any of the configurations described above.

Forces may be applied to the switching and actuating fluids 1018, 1020 in the same manner that they are applied to the switching and actuating fluids 918, 920 in FIG. 9. By using a suspended thin-film resistor, the stresses the resistors are subject to during the heating and cooling cycles may be reduced and the efficiency of the heating may be increased.

While illustrative and presently preferred embodiments of the invention have been described in detail herein, it is to be understood that the inventive concepts may be otherwise variously embodied and employed, and that the appended claims are intended to be construed to include such variations, except as limited by the prior art.

What is claimed is:

1. A device produced by:

depositing a first and second contact on a substrate;

depositing a sacrificial material, on the substrate at a location between the first and second contacts;

depositing a thin-film resistor over the first and second contacts and the sacrificial material; and thermally decomposing the sacrificial material.

2. The device of claim 1, wherein the thin-film resistor comprises a metallic resistor.

3. The device of claim 2, wherein the metallic resistor comprises molybdenum.

4. The device of claim 1, wherein the sacrificial material comprises polynorbornene.

5. The device of claim 1, wherein the first and second contacts have a lower resistance than the thin-film resistor.

6. A device comprising:

a substrate supporting first and second contacts;

a thin-film resistor deposited on the first and second contacts, a section of the thin-film resistor between the first and second contacts being suspended above the substrate.

7. The device of claim 6, wherein the first and second contacts have a lower resistance than the thin-film resistor.

8. The device of claim 6, wherein the thin-film resistor comprises a metal resistor.

9. A method comprising:

depositing a first and second contact on a substrate;

depositing a sacrificial material on the substrate and the first and second contacts, at a location between the first and second contacts;

depositing a thin-film resistor over the first and second contacts and the sacrificial material; and thermally decomposing the sacrificial material.

10. The method of claim 9, wherein depositing a sacrificial material comprises:

spin coating the sacrificial material on the substrate and the first and second contacts;

depositing a mask layer on the sacrificial material;

depositing photoresist material on the mask layer at a location between first and second contacts;

etching at least a portion of the mask layer;

removing the photoresist material; and reactive ion etching the sacrificial material not layered by the mask layer; and etching away at least a portion of the mask layer.

11. The method of claim 9, wherein the sacrificial material comprises polynorbornene.

12. A switch comprising:

first and second mated substrates defining therebetween at least portions of a number of cavities;

a switching fluid, held within one or more of the cavities, that is movable between at least first and second switch states in response to forces that are applied to the switching fluid;

an actuating fluid, held within one or more of the cavities, that applies said forces to said switching fluid;

first and second contacts, deposited on the first substrate at a location that is within one of the cavities holding the actuating fluid; and a thin-film resistor heater, deposited on the first and second contacts, a section of the thin-film resistor heater between the first and second contacts being suspended above the first substrate.

13. The switch of claim 12, wherein the first and second contacts have a lower resistance than the thin-film resistor.

* * * * *

UNITED STATES PATENT AND TRADEMARK OFFICE

CERTIFICATE OF CORRECTION

PATENT NO. : 6,833,520 B1
APPLICATION NO. : 10/462395
DATED : December 21, 2004
INVENTOR(S) : Marvin Glenn Wong and Ling Liu It is certified that error appears in the above-identified patent and that said Letters Patent is hereby corrected as shown below:

In the Claims

Col 6, Line 5 Before The device of claim 1, delete “5.” and insert -- 8. --

Col 6, Line 7 Before A device comprising, delete “6.” and insert -- 11. --

Col 6, Line 13 Before The device of claim 6, delete “7.” and insert -- 15. --

Col 6, Line 13 After claim, delete “6” and insert -- 11 --

Col 6, Line 15 Before The device of claim 6, delete “8.” and insert -- 16. --

Col 6, Line 15 After claim, delete “6” and insert -- 11 --

Col 6, Line 17 Before A method comprising:, delete “9.” and insert -- 17. --

Col 6, Line 26 Before The method of claim 9, delete “10.” and insert -- 18. --

Col 6, Line 26 After claim, delete “9” and insert -- 17 --

Col 6, Line 39 Before The method of claim 9, delete “11.” and insert -- 19. --

Col 6, Line 39 After claim, delete “9” and insert -- 17 --

Col 6, Line 41 Before A switch comprising:, delete “12.” and insert -- 20. --

Col 6, Line 57 Before The switch of claim 12, delete “13.” and insert -- 22. --

Col 6, Line 57 After claim, delete “12” and insert -- 20 --

UNITED STATES PATENT AND TRADEMARK OFFICE

CERTIFICATE OF CORRECTION

PATENT NO. : 6,833,520 B1
APPLICATION NO. : 10/462395
DATED : December 21, 2004
INVENTOR(S) : Marvin Glenn Wong and Ling Liu It is certified that error appears in the above-identified patent and that said Letters Patent is hereby corrected as shown below:

In the Claims

Col 6, Line 5 Before 8. The device, insert -- 5. The device of claim 1, further comprising before depositing the thin-film resistor, depositing a first support layer on the sacrificial material, and wherein depositing the thin-film resistor on the first support layer.
6. The device of claim 5, further comprising after depositing the thin-film resistor, depositing a second support layer on the thin-film resistor.
7. The device of claim 6 wherein the first support layer and the second support layer comprise silicon nitride. --

Col 6, Line 7 Before 11. A device comprising:, Insert -- 9. The device of claim 1, wherein depositing a thin-film resistor comprises depositing the thin-film resistor in a manner causing the thin-film resistor to be corrugated.
10. The device of claim 9, further comprising before depositing a sacrificial material, depositing support material on the substrate at a location between the first and second contacts, a section of the corrugated thin-film resistor being deposited on the support material. --

Col 6, Line 13 Before 15. The device of claim 11, insert -- 12. The device of claim 11, further comprising first and second conductive vias leading from a surface of the substrate to third and fourth contacts deposited on an opposite surface of the substrate.
13. The device of claim 11, further comprising support material deposited at a location between first and second contacts, the support material to support a portion of the thin-film resistor.
14. The device of claim 13, wherein the thin-film resistor comprises a corrugated material, a section of the thin-film resistor deposited on the support material. --

UNITED STATES PATENT AND TRADEMARK OFFICE

CERTIFICATE OF CORRECTION

PATENT NO. : 6,833,520 B1
APPLICATION NO. : 10/462395
DATED : December 21, 2004
INVENTOR(S) : Marvin Glenn Wong and Ling Liu It is certified that error appears in the above-identified patent and that said Letters Patent is hereby corrected as shown below:

In the Claims

Col 6, Line 56 Before 22. The switch of claim 20, insert -- 21. The switch of claim 20, Wherein the thin-film resistor comprises a corrugated material. --

Signed and Sealed this

Fifth Day of February, 2008

JON W. DUDAS
*Director of the United States Patent and Trademark Office*